US008971752B2

(12) United States Patent
Meguro et al.

(10) Patent No.: US 8,971,752 B2
(45) Date of Patent: Mar. 3, 2015

(54) BELT DEVICE AND IMAGE FORMING APPARATUS

(75) Inventors: Yuuji Meguro, Hyogo (JP); Masanari Fujita, Osaka (JP); Takeshi Sakashita, Hyogo (JP); Tetsushi Sakuma, Osaka (JP); Mitsutoshi Kichise, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 121 days.

(21) Appl. No.: 13/542,283

(22) Filed: Jul. 5, 2012

(65) Prior Publication Data

US 2013/0011158 A1 Jan. 10, 2013

(30) Foreign Application Priority Data

Jul. 7, 2011 (JP) ..... 2011-150913

(51) Int. Cl.
*G03G 15/16* (2006.01)
*G03G 21/00* (2006.01)
*G03G 15/01* (2006.01)

(52) U.S. Cl.
CPC ..... *G03G 15/161* (2013.01); *G03G 21/007* (2013.01); *G03G 15/0189* (2013.01); *G03G 15/1615* (2013.01); *G03G 2215/0132* (2013.01); *G03G 2215/1661* (2013.01)
USPC ..... 399/101; 399/121; 399/299

(58) Field of Classification Search
CPC ..... G03G 15/161; G03G 15/1615; G03G 21/007; G03G 2215/1661
USPC ..... 399/101, 121, 299
See application file for complete search history.

(56) References Cited

U.S. PATENT DOCUMENTS

| | | | |
|---|---|---|---|
| 7,599,633 | B2 | 10/2009 | Inoue et al. |
| 7,616,923 | B2 | 11/2009 | Hatayama et al. |
| 7,643,781 | B2 | 1/2010 | Sakashita et al. |
| 7,735,634 | B2 | 6/2010 | Miyazaki et al. |
| 7,751,762 | B2 | 7/2010 | Hatayama et al. |
| 7,778,568 | B2 | 8/2010 | Sakashita et al. |
| 7,860,421 | B2 | 12/2010 | Kichise et al. |

(Continued)

FOREIGN PATENT DOCUMENTS

| | | |
|---|---|---|
| JP | 3643099 | 2/2005 |
| JP | 2008-9011 | 1/2008 |

OTHER PUBLICATIONS

U.S. Appl. No. 13/421,532, filed Mar. 15, 2012, Takeshi Sakashita, et al.

(Continued)

*Primary Examiner* — Benjamin Schmitt
(74) *Attorney, Agent, or Firm* — Oblon, McClelland, Maier & Neustadt, L.L.P.

(57) ABSTRACT

A belt device includes: a belt that passes through a plurality of image forming units, each of the image forming units including a transfer member and an image carrier as a pair, the transfer member moves in a direction to contact with the belt and in a direction so as to be separated from the belt; a cleaning unit cleans an outer periphery of the belt after the belt passes through all the image forming units; and a pressing member is disposed between the cleaning unit and the image forming unit located on the most upstream side and that presses the outer periphery of the belt, wherein when the transfer member of at least one of the image forming units moves to be separated from the belt, the transfer member of the rest of the image forming units and the pressing member support the belt.

8 Claims, 8 Drawing Sheets

(56) References Cited

U.S. PATENT DOCUMENTS

| | | | | |
|---|---|---|---|---|
| 7,869,750 | B2 | 1/2011 | Hanashima et al. | |
| 7,869,751 | B2 | 1/2011 | Adachi et al. | |
| 7,904,010 | B2 | 3/2011 | Meguro et al. | |
| 7,970,297 | B2 | 6/2011 | Inoue et al. | |
| 7,970,336 | B2 | 6/2011 | Sakashita et al. | |
| 8,005,412 | B2 | 8/2011 | Sakashita et al. | |
| 8,045,887 | B2 | 10/2011 | Sakashita et al. | |
| 8,099,032 | B2 | 1/2012 | Iwami et al. | |
| 8,112,015 | B2 | 2/2012 | Kichise et al. | |
| 8,135,307 | B2 | 3/2012 | Inoue et al. | |
| 2003/0099492 | A1* | 5/2003 | Maeyama et al. | 399/302 |
| 2007/0201898 | A1* | 8/2007 | Mochizuki | 399/101 |
| 2008/0003022 | A1* | 1/2008 | Sakashita et al. | 399/303 |
| 2008/0138133 | A1 | 6/2008 | Hatayama et al. | |
| 2009/0016772 | A1 | 1/2009 | Adachi et al. | |
| 2011/0058859 | A1* | 3/2011 | Nakamatsu et al. | 399/299 |
| 2012/0057908 | A1 | 3/2012 | Meguro | |
| 2012/0114373 | A1 | 5/2012 | Hamada et al. | |

OTHER PUBLICATIONS

U.S. Appl. No. 13/405,675, filed Feb. 27, 2012, Masanari Fujita, et al.

* cited by examiner

OUTER PERIMETER: Lt

PERFECT CIRCLE WITH AREA S
OUTER PERIMETER: Lc

BELT DEVICE AND IMAGE FORMING APPARATUS

CROSS-REFERENCE TO RELATED APPLICATIONS

The present application claims priority to and incorporates by reference the entire contents of Japanese Patent Application No. 2011-150913 filed in Japan on Jul. 7, 2011.

BACKGROUND OF THE INVENTION

1. Field of the Invention

The present invention relates to a belt device and an image forming apparatus.

2. Description of the Related Art

In an image forming apparatus of an intermediate transfer system among various image forming apparatuses, such as copiers, printers, facsimile machines, and multifunction peripherals having functions of a copier, a printer, and a facsimile machine, a toner image formed on a photosensitive drum is transferred onto a transfer belt (primary transfer) and then the toner image on the transfer belt is transferred onto a recording sheet (secondary transfer). The belt device having a transfer belt of this type includes a cleaning unit on the upstream side of the photosensitive drum in order to remove non-transferred toner attached to the transfer belt. An example of the belt device having a cleaning unit of this type is disclosed in, for example, Japanese Patent Laid-open Publication No. 2008-9011 (hereinafter, described as "Patent Document 1").

In the belt device disclosed in Patent Document 1, a photosensitive drum on the most upstream side is disposed such that the center shaft thereof is positioned closer to the transfer belt than the center shafts of other photosensitive drums so that the amount of contact between the transfer belt and a cleaning opposing roller can be increased to improve the cleaning performance of the cleaning unit (see, for example, a paragraph [0036] of Patent Document 1).

However, in the configuration disclosed in Patent Document 1, the belt is wound around the opposing roller by being stretched outward by the opposing roller. Therefore, the opposing roller needs to be disposed at an offset position outward from a belt extended line between the photosensitive drum located on the most upstream side and the driving roller. Therefore, the thickness of the belt device (the maximum size between the outer periphery on a belt forwarding side and the outer periphery on a belt returning side) increases, resulting in an increase in a space needed for the belt device in the thickness direction. In particular, when the angle of contact between the belt and the opposing roller is increased to improve the cleaning performance, the opposing roller needs to be disposed further outward, and therefore, the above-mentioned problems become more apparent.

Meanwhile, when the image forming apparatus switches from a color mode to a monochrome (single color) mode, there is a demand to stop and separate the photosensitive drums other than the photosensitive drum used in the monochrome mode from the transfer belt in order to reduce abrasion of the surfaces of the photosensitive drums or to save power consumption. Therefore, there is a need for the belt device that can meet the above demand.

Therefore, there is a need to provide a belt device and an image forming apparatus that can easily cope with image formation in the monochrome mode and that are compact in size.

SUMMARY OF THE INVENTION

It is an object of the present invention to at least partially solve the problems in the conventional technology.

According to an aspect of the present invention, there is provided a belt device including: a belt that has an endless shape and sequentially passes through a plurality of image forming units, each of the image forming units including a transfer member and an image carrier as a pair, and the transfer member being movable in a direction in which the transfer member comes into contact with the belt and in a direction in which the transfer member is separated from the belt; a cleaning unit that cleans an outer periphery of the belt after the belt passes through all the image forming units; and a pressing member that is disposed between the cleaning unit and the image forming unit located on the most upstream side and that presses the outer periphery of the belt, wherein when the transfer member of at least one of the image forming units moves in the direction in which the transfer member is separated from the belt, the transfer member of rest of the image forming units and the pressing member support the belt.

According to another aspect of the present invention, there is provided an image forming apparatus includes: a belt device including a belt that has an endless shape and sequentially passes through a plurality of image forming units, each of the image forming units including a transfer member and an image carrier as a pair, and the transfer member being movable in a direction in which the transfer member comes into contact with the belt and in a direction in which the transfer member is separated from the belt, a cleaning unit that cleans an outer periphery of the belt after the belt passes through all the image forming units, and a pressing member that is disposed between the cleaning unit and the image forming unit located on the most upstream side and that presses the outer periphery of the belt, wherein when the transfer member of at least one of the image forming units moves in the direction in which the transfer member is separated from the belt, the transfer member of rest of the image forming units and the pressing member support the belt; a secondary image-transfer unit that transfers an unfixed image formed on the belt of the belt device onto a recording medium; and a fixing unit that fixes the image on the recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
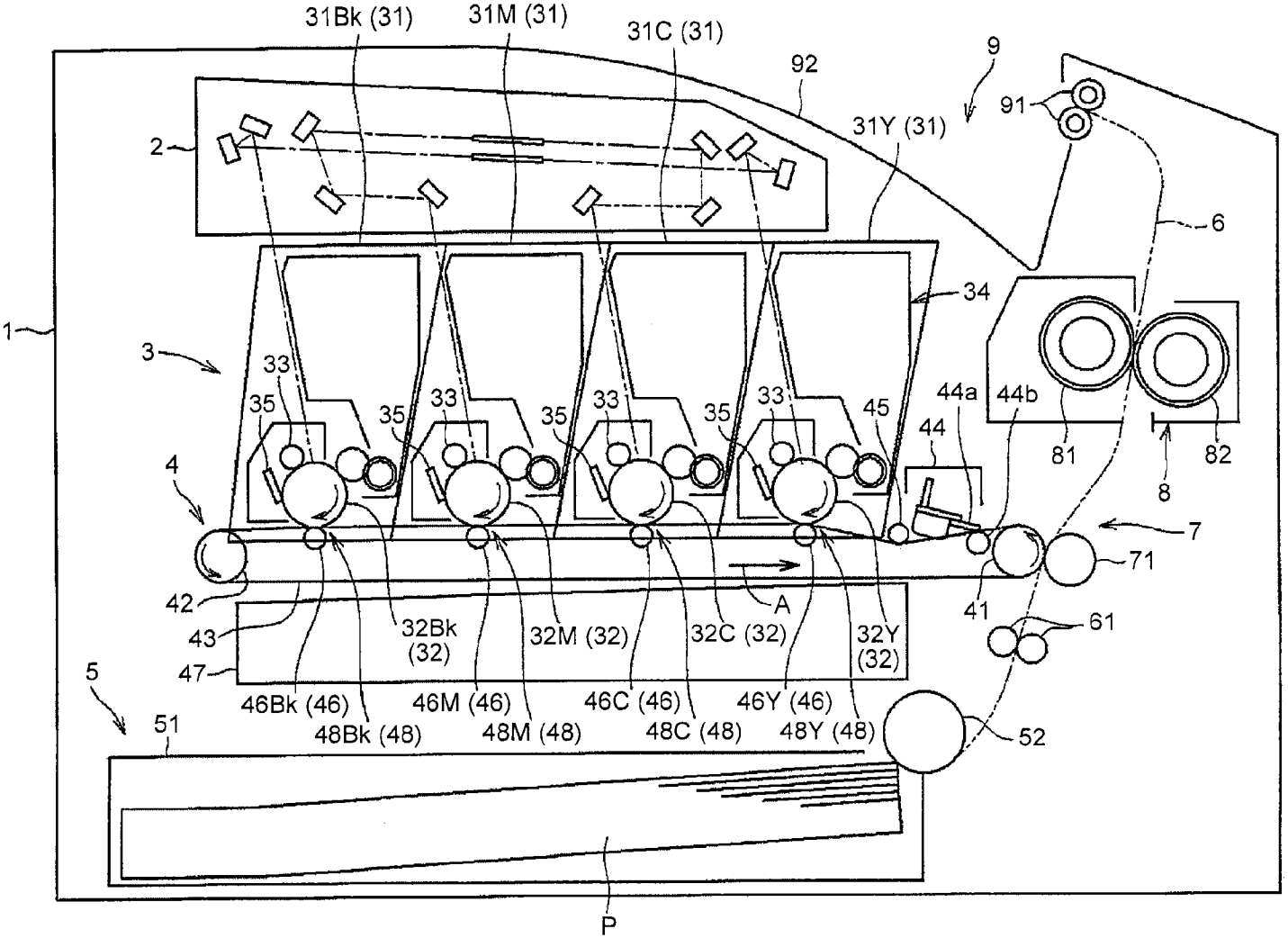
FIG. 1 is a cross-sectional view of a color image forming apparatus according to an embodiment.

Exemplary embodiments of the present invention will be explained in detail below with reference to the accompanying drawings. In the drawings illustrating the embodiments, the same elements such as components or component parts having the same functions or the same shapes are denoted by the same reference numerals or symbols as long as the elements are identifiable, and therefore, the same explanation will not be repeated below.

FIG. 1 is a schematic configuration diagram of a color image forming apparatus according to an embodiment of the present invention. The color image forming apparatus illustrated in FIG. 1 includes an apparatus main body 1, an exposing unit 2, an image forming unit 3, a belt device 4, a sheet feed unit 5, a conveying path 6, a secondary image-transfer unit 7, an image fixing unit 8, a discharging unit 9, or the like.

The exposing unit 2 is located in the upper side of the apparatus main body 1 and includes a light source that emits a laser beam or various optical systems. Specifically, the exposing unit 2 emits a laser beam for each of color-separated components of an image to be generated based on image data obtained by an image acquiring unit (not illustrated) toward a photosensitive member of the image forming unit 3 to be described 11 below, thereby exposing the surface of the photosensitive member.

The image forming unit 3 is located below the exposing unit 2 and includes a plurality of process units 31 that are detachably attachable to the apparatus main body 1. Each of the process units 31 includes a photosensitive drum 32 that serves as an image carrier for carrying toner being a developer on the surface of the photosensitive drum 32, a charging roller 33 that uniformly charges the surface of the photosensitive drum 32, a developing device 34 that supplies toner to the surface of the photosensitive drum 32, a cleaning unit 35 that cleans the surface of the photosensitive drum 32, or the like. As the process units 31, four process units 31 (31Y, 31C, 31M, and 31Bk) are provided for respective colors of yellow, cyan, magenta, and black that are the color-separated components of a color image. The process units 31 have the same configurations except for colors of toner stored therein.

The belt device 4 is located just below the image forming unit 3. The belt device 4 includes an intermediate transfer belt 43 that is an endless belt wound around a driving roller 41 and a driven roller 42, which serve as supporting members, in a rotationally movable manner, a cleaning unit 44 that cleans the surface of the intermediate transfer belt 43, a pressing roller 45 that serves as a pressing member for pressing the outer periphery of the intermediate transfer belt 43 inward, primary transfer rollers 46 that serve as a transfer member and are located opposite the photosensitive drums 32 across the intermediate transfer belt 43, or the like. A waste toner container 47 for housing waste toner collected by the cleaning unit 44 through cleaning is disposed below the intermediate transfer belt 43 via a waste toner transfer hose (not illustrated).

The cleaning unit 44 includes a cleaning blade 44*a* that slides on the outer periphery of the intermediate transfer belt 43 to clean up toner from the outer periphery of the intermediate transfer belt 43, and a cleaning opposing roller 44*b* that is in contact with the inner periphery of the intermediate transfer belt 43 at the position opposite the cleaning blade 44*a*.

The photosensitive drums 32 of the process units 31 and the primary transfer rollers 46 of the belt device 4 form image forming units 48, respectively.

As the primary transfer rollers 46, four primary transfer rollers 46 (46Y, 46C, 46M, and 46Bk) are disposed opposite the four photosensitive drums 32 (32Y, 32C, 32M, and 32Bk) for the respective colors of yellow, cyan, magenta, and black as the color-separated components of a color image. Therefore, the four image forming units 48 (48Y, 48C, 48M, and 48Bk), each of which is formed of a corresponding pair of the photosensitive drum 32 and the primary transfer roller 46, are formed at four positions on the intermediate transfer belt 43 in a moving direction of the intermediate transfer belt 43. The cleaning unit 44 is located upstream of the image forming unit 48Y on the most upstream side and is disposed linearly along the four image forming units 48. The cleaning opposing roller 44*b* of the cleaning unit 44 and the primary transfer rollers 46 (46Y, 46C, 46M, and 46Bk) are disposed such that the intermediate transfer belt 43 wound around the driving roller 41 and the driven roller 42 is stretched outward. The primary transfer rollers 46 press the inner periphery of the intermediate transfer belt 43 at the respective positions, so that primary transfer nips are formed between the primary transfer rollers 46 and the photosensitive drums 32, respectively.

To cope with a monochrome mode to be described later, of all the primary transfer rollers 46, the primary transfer rollers 46Y, 46C, and 46M except for the primary transfer roller 46Bk of the image forming unit 48Bk for black are movable by a driving mechanism (not illustrated) in directions in which the primary transfer rollers 46Y, 46C, and 46M come into contact with and away from the intermediate transfer belt 43.

The sheet feed unit 5 is located in the lower side of the apparatus main body 1 and includes a sheet feed tray 51 for housing a recording sheet P as a recording medium, a sheet feed roller 52 for taking out the recording sheet P from the sheet feed tray 51, or the like.

The conveying path 6 is a conveying pathway for conveying the recording sheet P taken out from the sheet feed unit 5. Conveying roller pairs (not illustrated) including a registration roller pair 61 are appropriately disposed on the conveying path 6 toward the discharging unit 9 to be described later.

The secondary image-transfer unit 7 is located in the middle of the conveying path 6 and includes the driving roller 41 of the intermediate transfer belt 43, and a secondary transfer roller 71 disposed opposite the driving roller 41 across the intermediate transfer belt 43. The secondary transfer roller 71 presses the outer periphery of the intermediate transfer belt 43, so that a secondary transfer nip is formed between the secondary transfer roller 71 and the driving roller 41.

The image fixing unit 8 is located downstream of the secondary image-transfer unit 7 on the conveying pathway and includes a fixing roller 81 heated by a heat source (not illustrated), a pressurizing roller 82 that applies pressure to the fixing roller 81, or the like.

The discharging unit 9 is located on the most downstream side of the conveying path in the apparatus main body 1 and includes a sheet discharge roller pair 91 for discharging the recording sheet P to the outside and a sheet discharge tray 92 for stacking a discharged recording medium.

A basic operation of the color image forming apparatus described above will be explained below with reference to FIG. 1.

In the image forming apparatus, when an image formation in a color mode is started, the photosensitive drums 32 of the process units 31Y, 31C, 31M, and 31Bk are rotated clockwise in FIG. 1 by a driving device (not illustrated), and the charging rollers 33 uniformly charge the surfaces of the photosensitive drums 32 with a predetermined polarity. The exposing unit 2 applies laser beams for respective color components of an image to be formed to the charged surfaces of the photosensitive drums 32, so that electrostatic latent images are formed on the surfaces of the photosensitive drums 32. At this time, image information exposed on each of the photosensitive drums 32 is information on a single-color image that is obtained by separating a desired full-color image into pieces of color information on yellow, cyan, magenta, and black. The developing devices 34 supply toner as a developer onto the electrostatic latent images formed on the photosensitive drums 32, so that the electrostatic latent images are visualized as toner images (developed images) that are visible images. As the developer, one-component developer formed of only toner or two-component developer formed of toner and carrier may be used.

Subsequently, the driving roller 41 of the belt device 4 is rotated counterclockwise in FIG. 1, so that the intermediate transfer belt 43 moves in an arrow A direction in FIG. 1. A constant voltage with a polarity opposite the polarity of charged toner or a voltage subjected to constant current control is applied to the primary transfer rollers 46. Therefore, transfer electric fields are formed at the respective primary transfer nips between the primary transfer rollers 46 and the photosensitive drums 32. Subsequently, the toner images for the respective colors formed on the photosensitive drums 32 of the process units 31Y, 31C, 31M, and 31Bk are transferred onto the intermediate transfer belt 43 in a superimposed manner by the transfer electric fields formed at the primary transfer nips. As a result, a full-color toner image (an unfixed image), in which the images formed by the image forming units 48 are superimposed on one another, is formed on the surface of the intermediate transfer belt 43 after the intermediate transfer belt 43 passes through the image forming units 48 (48Y, 48C, 48M, and 48Bk). The transfer member is not limited to the primary transfer rollers 46. A conductive member, such as a brush, may be used as the transfer member.

Subsequently, the cleaning unit 35 removes non-transferred toner attached to the surfaces of the photosensitive drums 32 and a neutralizing device (not illustrated) neutralizes the surfaces of the photosensitive drums 32, so that the surface potential is initialized in preparation for next image formation. It is possible not to provide the cleaning unit 35 but to cause the developing devices 34 to collect the non-transferred toner attached to the surfaces of the photosensitive drums 32. Alternatively, it is possible to employ various known cleaning means. The intermediate transfer belt 43 further moves along with the rotation of the driving roller 41, so that the toner images formed on the surface of the intermediate transfer belt 43 are conveyed toward the secondary image-transfer unit 7.

Meanwhile, in the lower side of the apparatus main body 1, a recording sheet P housed in the sheet feed tray 51 is fed toward the conveying path 6 along with rotation of the sheet feed roller 52 of the sheet feed unit 5. The recording sheet P fed to the conveying path 6 is conveyed to the secondary transfer nip between the secondary transfer roller 71 of the secondary image-transfer unit 7 and the driving roller 41 opposite the secondary transfer roller 71 at a certain timing adjusted by the registration roller pair 61. At the secondary transfer nip, the full-color toner image formed on the surface of the intermediate transfer belt 43 is transferred onto the recording sheet P. At this time, a transfer voltage with a polarity opposite the polarity of charged toner attached to the toner image on the intermediate transfer belt 43 is applied to the secondary transfer roller 71, so that a transfer electric field is formed at the secondary transfer nip. The toner images formed on the intermediate transfer belt 43 are collectively transferred (transfer by attractive force) onto the recording sheet P due to the transfer electric field formed at the secondary transfer nip.

It may be possible to apply a transfer voltage with the same polarity as the polarity of charged toner to the driving roller 41 in the secondary image-transfer unit 7 so that the toner images can be transferred onto the recording sheet P by repulsive force against the driving roller 41 (transfer by repulsive force).

Thereafter, non-transferred toner attached to the intermediate transfer belt 43 is removed by the cleaning blade 44*a* of the cleaning unit 44. The removed toner is conveyed and collected into the waste toner container 47 by a screw (not illustrated), a toner transfer hose (not illustrated), or the like.

Subsequently, the recording sheet P on which the toner image is transferred is conveyed to the image fixing unit 8, where the heated fixing roller 81 and the pressurizing roller 82 apply heat and pressure to the recording sheet P to fix the toner image on the recording sheet P. The recording sheet P on which the toner image is fixed is conveyed by the conveying roller pairs (not illustrated) and discharged to the sheet discharge tray 92 by the sheet discharge roller pair 91 of the discharging unit 9. The fixation operation may be performed by the secondary image-transfer unit 7.

The belt device 4 of the image forming apparatus according to the embodiment will be explained in detail below with reference to FIGS. 2 and 3.

Figure 2:
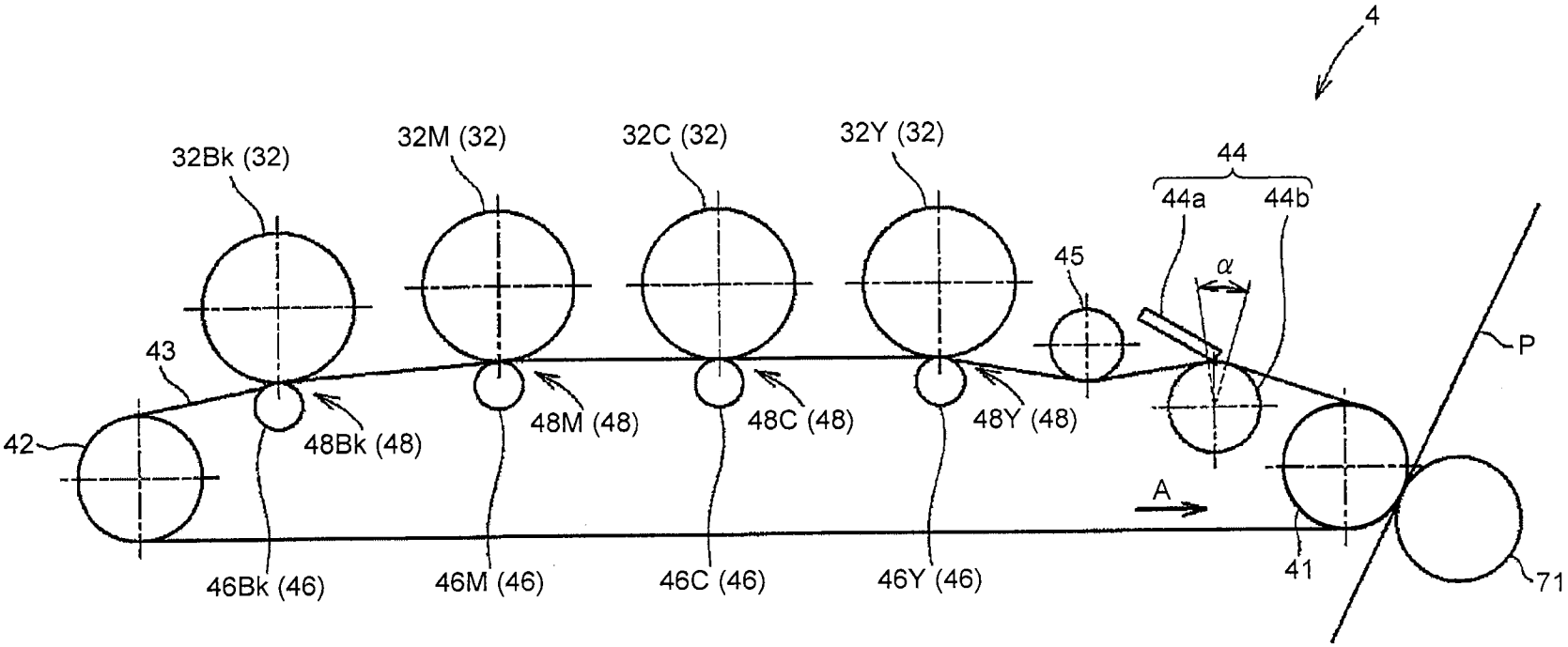
FIG. 2 is a side view illustrating a schematic configuration of a belt device according to the embodiment.

As illustrated in FIG. 2, in the belt device 4, the pressing roller 45 is disposed at a fixed position between the image forming unit 48Y located on the most upstream side in the moving direction of the intermediate transfer belt 43 and the cleaning unit 44 (specifically, between the primary transfer nip located on the most upstream side and a contact portion of the cleaning blade 44*a* and the cleaning opposing roller 44*b*). The pressing roller 45 presses the intermediate transfer belt 43 so that the intermediate transfer belt 43 is in a reversely-bent state, in which the intermediate transfer belt 43 is bent inward from a belt extended line between the photosensitive drum 32Y and the cleaning opposing roller 44*b*.

In this way, by disposing the pressing roller 45 between the image forming unit 48Y and the cleaning unit 44, it is possible to press the pressing roller 45 against the surface of the intermediate transfer belt 43 that has been cleaned. Therefore, it is possible to prevent non-transferred toner remaining on the intermediate transfer belt 43 from being attached to the surface of the pressing roller 45. Furthermore, it is possible to prevent non-transferred toner attached to the pressing roller 45 from being attached to the intermediate transfer belt 43 again. Therefore, it is possible to prevent the intermediate transfer belt 43 from getting dirty, enabling to prevent adverse effects on image quality. As a result, it is possible to lengthen the lifetime of the intermediate transfer belt 43, enabling to provide the color image forming apparatus that can form an image of stable quality.

In contrast with the present embodiment, when the pressing roller 45 is disposed upstream of the cleaning unit 44 and it is desired to prevent the above disadvantage, for example, it is necessary to apply a bias with the same polarity as the polarity of the toner to the pressing roller 45 or to coat the surface of the pressing roller 45 with a low friction material, such as fluorine resin, in order to prevent non-transferred toner from being attached to the pressing roller 45. However, this may increase costs. By contrast, by disposing the pressing roller 45 between the image forming unit 48Y located on the most upstream side and the cleaning unit 44 as described above, it is possible to obtain a high-quality image at low costs.

Figure 3:
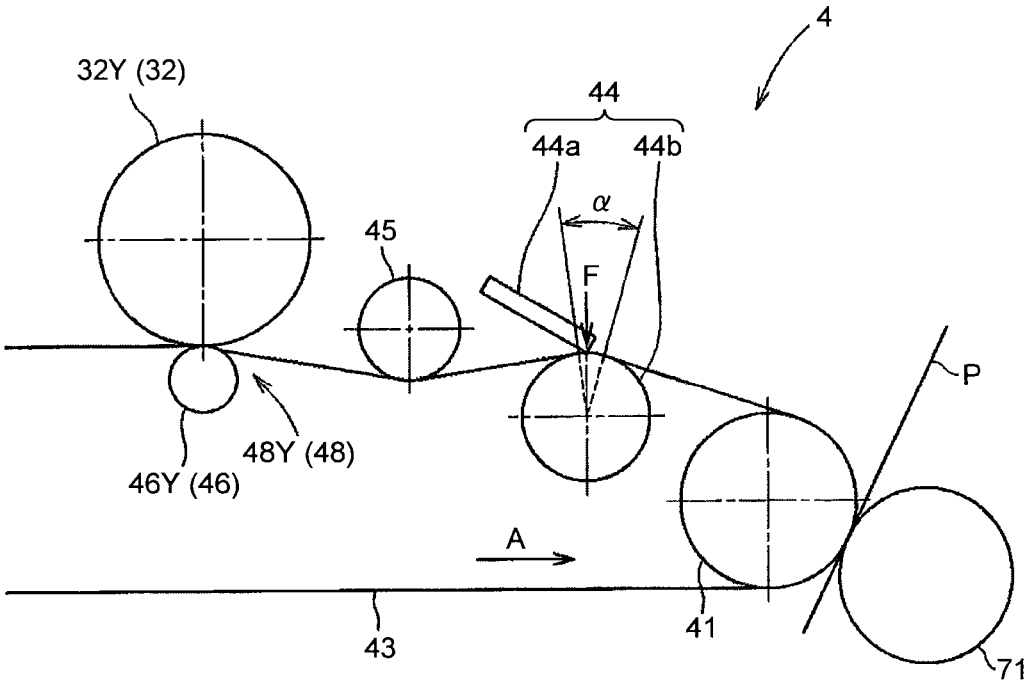
FIG. 3 is an enlarged view of the belt device illustrated in FIG. 2.

FIG. 3 is an enlarged view of the belt device 4. As illustrated in FIG. 3, the intermediate transfer belt 43 is reversely bent by the pressing roller 45, so that an angle of contact α between the intermediate transfer belt 43 and the outer periphery of the cleaning opposing roller 44*b* increases. The cleaning blade 44*a* slides on the intermediate transfer belt 43 at a linear pressure F to be described later within the range of the angle of contact α. In this way, by securing the adequate angle of contact α, it is possible to stably move the intermediate transfer belt 43 and cause the cleaning blade 44*a* to stably perform cleaning.

Figure 9:
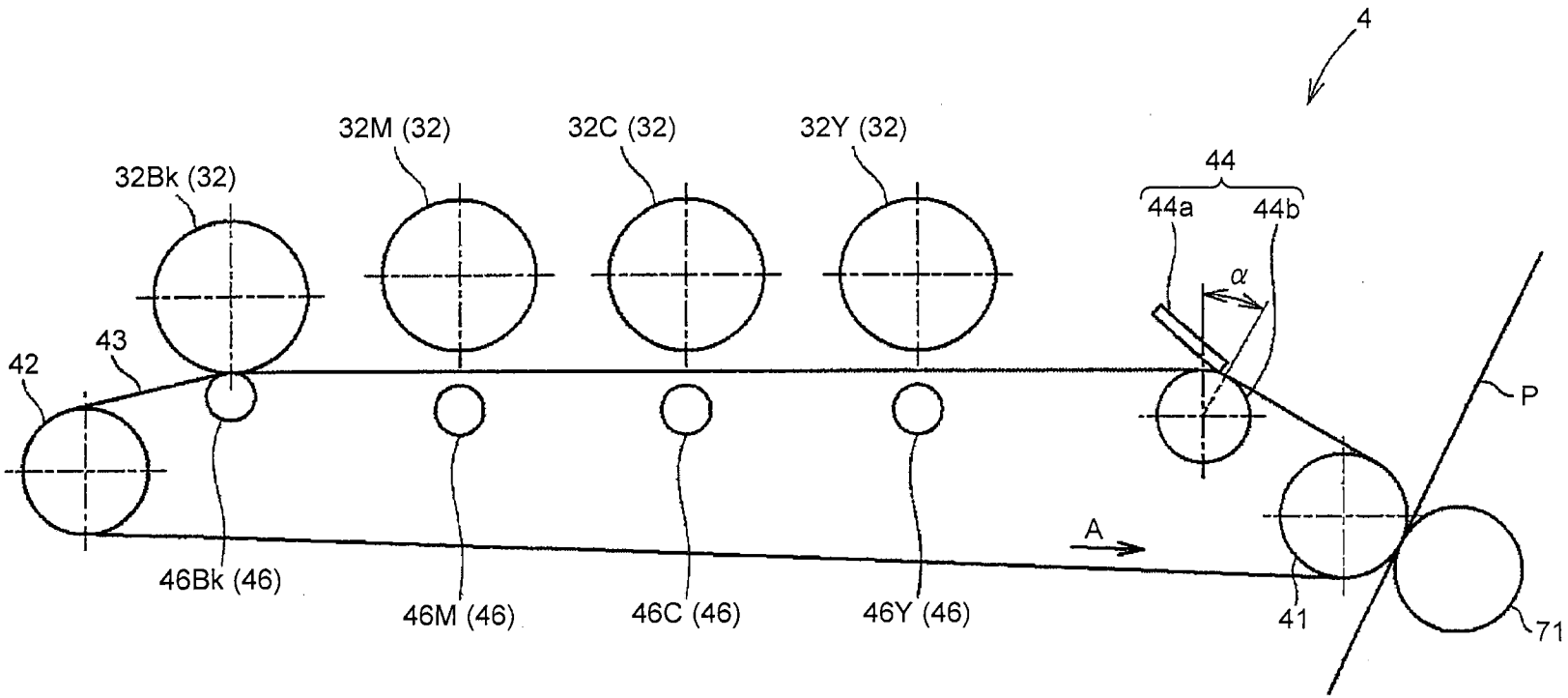
FIG. 9 is a schematic diagram for explaining a technology related to the belt device.

When the pressing roller 45 is not used, as illustrated in FIG. 9 for example, the angle of contact α may be increased by increasing the amount of offset of the cleaning opposing roller 44*b* toward the outside (the amount of offset in a direction away from a line connecting the center of the driving roller 41 and the center of the driven roller 42). However, in this case, the size of the belt device 4 in the thickness direction increases and the flexibility in arrangement of the cleaning opposing roller 44*b* and the driving roller 41 in the vertical direction is limited, resulting in reduced flexibility in design or increased size of the image forming apparatus. By contrast, by reversely bending the intermediate transfer belt 43 by using the pressing roller 45 as described above, it is possible to increase the amount of pressing the pressing roller 45 inward, enabling to increase the angle of contact α. Therefore, it is not necessary to increase the amount of offset of the cleaning opposing roller 44*b* toward the outside, enabling to prevent an increase in the size of the belt device 4 in the thickness direction and reduce the entire size of the belt device.

Figure 4:
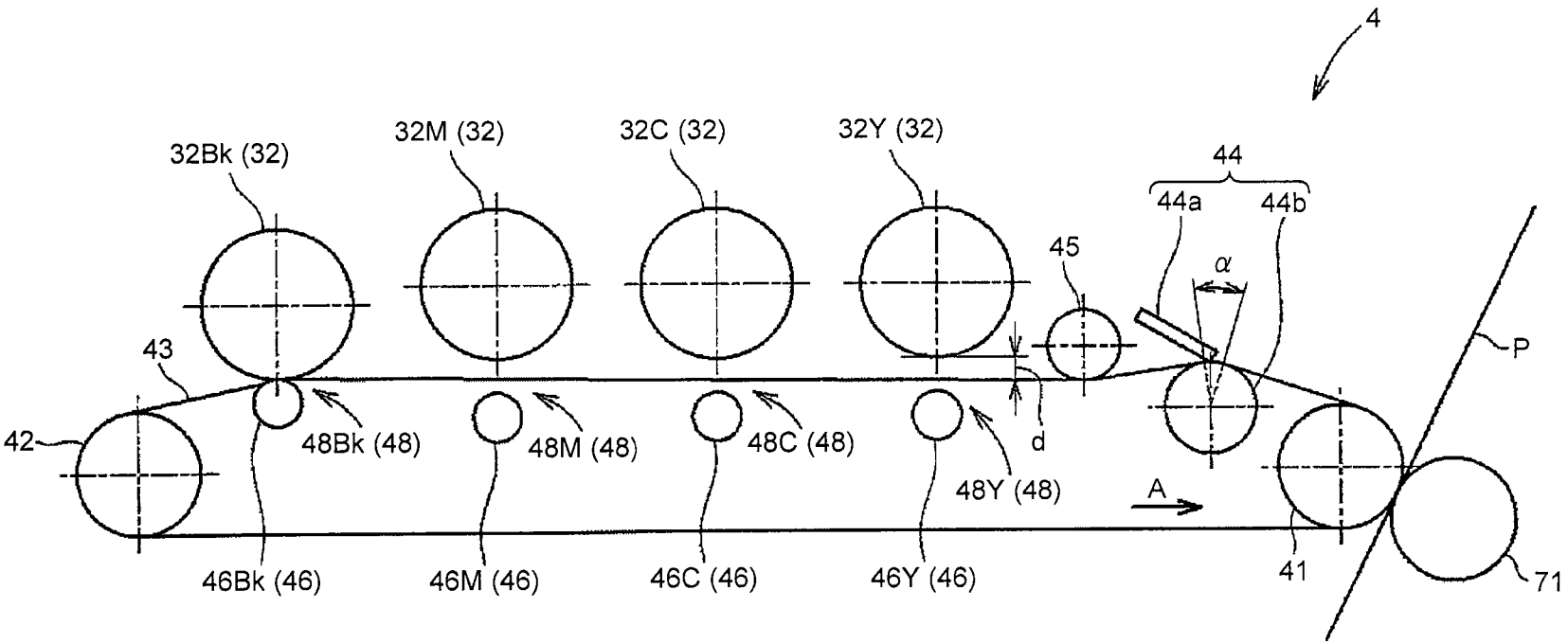
FIG. 4 is a side view illustrating a schematic configuration of the belt device when a single-color image is formed.

When the image forming apparatus described above switches from the color mode to the monochrome mode, as illustrated in FIG. 4, some of the image forming units, that is, the image forming units for colors other than a color used in the monochrome mode (for example, the image forming units 48Y, 48C, and 48M for colors), activate the driving mechanisms of the primary transfer rollers 46Y, 46C, and 46M in order to move the primary transfer rollers 46Y, 46C, and 46M in a direction in which the primary transfer rollers 46Y, 46C, and 46M are separated from the intermediate transfer belt 43. On the other hand, other image forming unit, that is, the image forming unit corresponding to the color to be used (for example, the image forming unit 48Bk for black) does not move the primary transfer roller 46Bk, so that the primary transfer nip is maintained.

In the present embodiment, the pressing roller 45 presses the intermediate transfer belt 43 from the outside to the inside to reversely bend the intermediate transfer belt 43. Therefore, when the primary transfer rollers 46Y, 46C, and 46M move, the intermediate transfer belt 43 is changed to a non-contact state, in which the intermediate transfer belt 43 is separated from the photosensitive drums 32Y, 32C, and 32M of the image forming units 48Y, 48C, and 48M for colors. Accordingly, the intermediate transfer belt 43 is supported by the primary transfer roller 46Bk of the image forming unit 48Bk for black located on the most downstream side and the pressing roller 45. Therefore, it is possible to stop the photosensitive drums 32Y, 32C, and 32M for colors during printing, enabling to reduce abrasion of the surfaces of the photosensitive drums or save power consumption. At this time, it is desirable to move the primary transfer rollers 46Y, 46C, and 46M for colors to positions where the primary transfer rollers 46Y, 46C, and 46M are not in contact with the intermediate transfer belt 43.

To cope with the monochrome mode, as illustrated in FIGS. 2 and 4, it is desirable to align the rotation centers of the photosensitive drums 32Y, 32C, and 32M for colors on a line and set the line to be parallel to a belt extended line between the pressing roller 45 and the image forming unit 48Bk for black. With this configuration, a gap d between each of the photosensitive drums 32Y, 32C, and 32M of the image forming units 48 for colors and the intermediate transfer belt 43 can be uniform, so that it is possible to assuredly prevent each of the photosensitive drums 32Y, 32C, and 32M for colors from coming into contact with the intermediate transfer belt 43. In this case, it is desirable to arrange the rotation center of the photosensitive drum 32Bk for black at a position closer to the intermediate transfer belt 43 than the rotation centers of the photosensitive drums 32Y, 32C, and 32M for colors.

As described in the present embodiment, when the pressing roller 45 is disposed between the image forming unit 48Y located on the most upstream side and the cleaning unit 44, the angle of contact α of the cleaning opposing roller 44*b* does not change before and after the primary transfer rollers 46Y, 46C, and 46M move in the direction in which the primary transfer rollers 46Y, 46C, and 46M are separated from the intermediate transfer belt 43 or in the direction in which the primary transfer rollers 46Y, 46C, and 46M come into contact with the intermediate transfer belt 43. Therefore, the cleaning unit 44 can achieve the same cleaning performance both in the color mode and in the monochrome mode.

In the above example, it is explained that the image forming units 48 for respective colors are arranged in the order of the image forming units 48 for yellow, cyan, magenta, and black toward the downstream side in the conveying direction of the intermediate transfer belt 43; however, the order of arranging the image forming units 48 is not limited to this example. Even when a single or a plurality of the image forming units 48 are used for image formation without using the rest of the image forming units 48, similarly to the above, it is possible to move the unused image forming units 48 to the positions at which the primary transfer rollers 46 do not come into contact with the intermediate transfer belt 43, support the intermediate transfer belt 43 by the primary transfer rollers 46 of the image forming units 48 corresponding to colors to be used and the pressing roller 45, and separate the photosensitive drums 32 of the unused image forming units 48 from the intermediate transfer belt 43. Furthermore, while it is explained that a part of the primary transfer rollers (the primary transfer roller 46Bk for black) is disposed at the fixed position, it is possible to configure the image forming unit 48Bk so that the image forming unit 48Bk can move in directions in which the image forming unit 48Bk comes in contact with and away from the intermediate transfer belt 43, similarly to the primary transfer rollers 46Y, 46C, and 46M. Namely, it is possible to configure all the primary transfer rollers 46Y, 46C, 46M, and 46Bk such that the primary transfer rollers 46Y, 46C, 46M, and 46Bk can move in directions approaching and away from the intermediate transfer belt 43.

In the color image forming apparatus of the present embodiment, when, for example, spherical toner with average circularity of 0.98 or greater is used, the liner pressure F of the cleaning blade 44*a* against the intermediate transfer belt 43 needs to be set to at least 40 N/m or greater in order to secure adequate cleaning performance of the cleaning blade 44*a*. The linear pressure F of the cleaning blade 44*a* against the intermediate transfer belt 43 is a value obtained by dividing the total weight applied to the cleaning blade 44*a* by a length of an edge line of a tip portion of the cleaning blade 44*a* pressed against the intermediate transfer belt 43.

Figure 7:
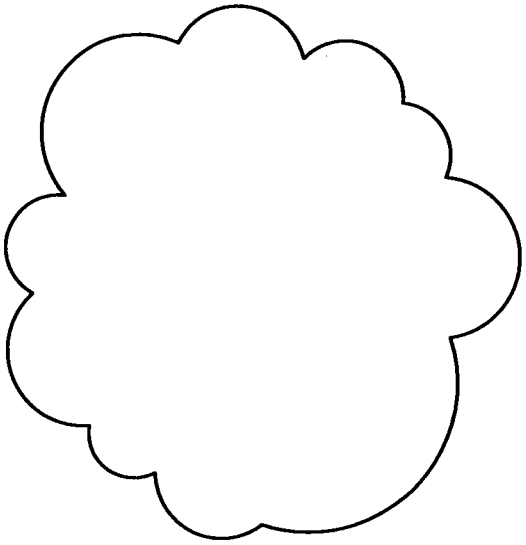
FIG. 7 is a schematic diagram for explaining an outer perimeter of a projected image of a toner.
Figure 8:
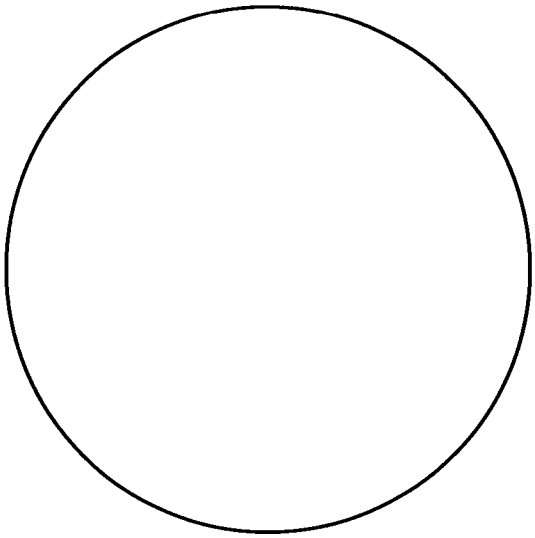
FIG. 8 is a schematic diagram for explaining an outer perimeter of a perfect circle with the same projected area as that of the toner.

The average circularity of toner can be measured by using flow particle image analyzer FPIA-2000 (which is the name of a product manufactured by Sysmex Corporation). Specifically, a surfactant, or more preferably, alkylbenzene sulfonate of 0.1 milliliter to 0.5 milliliter is added as a dispersant to water of 100 milliliters to 150 milliliters in a container from which impure solids are removed in advance, and a measurement sample (toner) of approximately 0.1 gram to 0.5 gram is further added to the water. Thereafter, the suspended solution, in which the toner is dispersed, is subjected to dispersion treatment by an ultrasonic disperser for about 1 minute to 3 minutes to obtain the dispersion liquid at the concentration of 30 millions per microliter to 10 thousands per microliter, and the dispersion liquid is set in the analyzer to measure the size and the distribution of the toner. By using the measurement result, Lc/Lt is obtained, where Lc is the outer perimeter of the projected shape of the toner (FIG. 7) and Lt is the outer perimeter Lc of a perfect circle having the same area as a projected area S of the toner (FIG. 8), and thereafter, an average of obtained values Lc/Lt is obtained as the circularity.

In the present embodiment, when spherical toner with the average circularity of 0.98 or greater is used, linear pressure F1 of the cleaning blade 44*a* is set to 45 N/m. In this way, when the linear pressure F1 of the cleaning blade 44*a* is set to 40 N/m or greater to secure adequate cleaning performance, resistance of the cleaning blade 44*a* due to the movement of the intermediate transfer belt 43 in the moving direction increases. Therefore, the intermediate transfer belt 43 is deflected at a position upstream of the contact position of the cleaning blade 44*a* and the intermediate transfer belt 43 in the moving direction of the intermediate transfer belt 43, so that the oscillation (behavior) of the intermediate transfer belt 43 easily becomes unstable. By contrast, in the present embodiment, because the pressing roller 45 presses the intermediate transfer belt 43, a tensile force is applied to the intermediate transfer belt 43. Therefore, it is possible to prevent deflection of the intermediate transfer belt 43.

Figure 5:
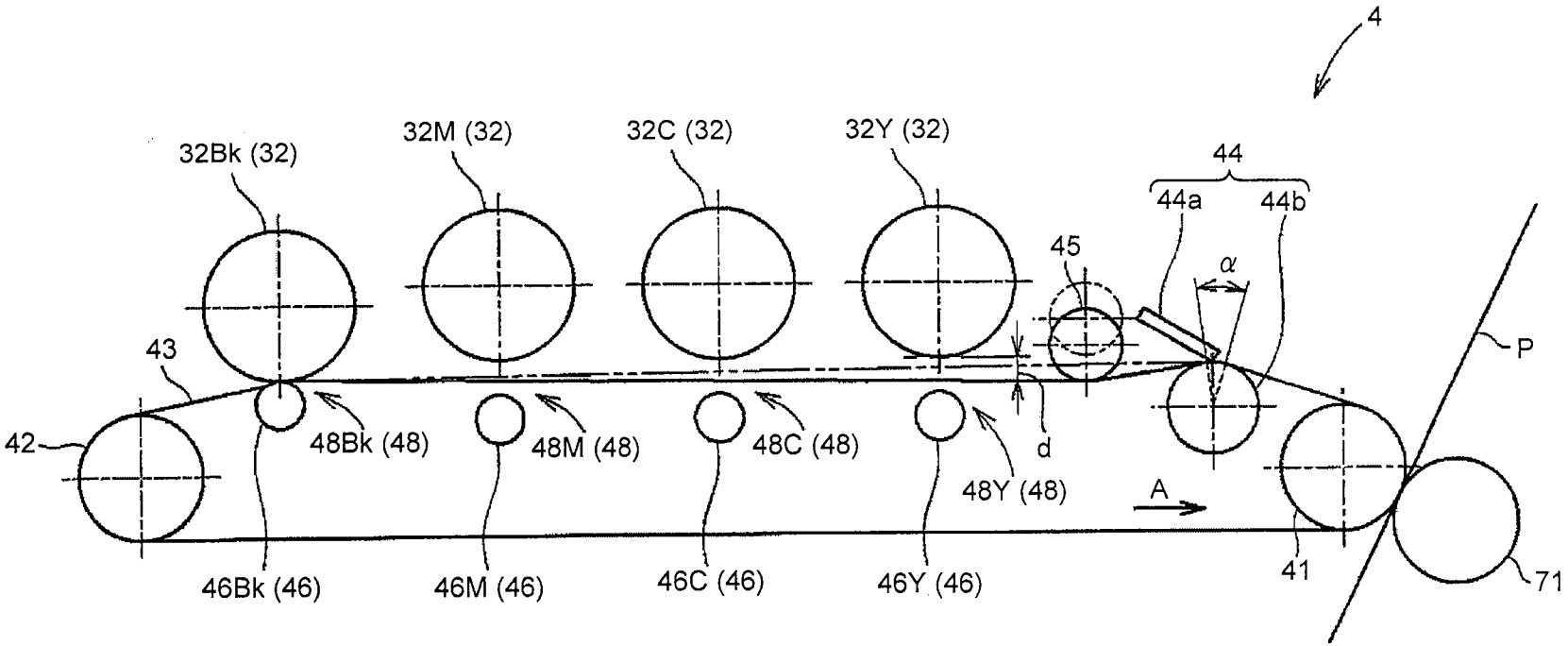
FIG. 5 is a side view illustrating a schematic configuration of a belt device according to another embodiment.

In the above example, it is explained that the pressing roller 45 is disposed at the fixed position. However, the pressing roller 45 may be configured such that the pressing roller 45 is movable in directions in which the pressing roller 45 comes in contact with and away from the intermediate transfer belt 43 as illustrated in FIG. 5. With this configuration, for example, the pressing roller 45 can be moved to and maintained at the position separated from the intermediate transfer belt 43 while the belt device 4 is deactivated or not in use. Therefore, it is possible to prevent the intermediate transfer belt 43 from being permanently deformed or being permanently curled due to the press against the pressing roller 45 for a long time.

Even when the pressing roller 45 is separated from the intermediate transfer belt 43 as described above, as indicated by a chain double-dashed line in FIG. 5, it is desirable to set the position of the cleaning opposing roller 44*b* such that the intermediate transfer belt 43 does not come into contact with the photosensitive drums 32 (in particular, the intermediate transfer belt 43 does not come into contact with the photosensitive drums 32Y, 32C, and 32M during printing in the monochrome mode). When both of the photosensitive drums 32 and the intermediate transfer belt 43 are stopped, it is allowable that the photosensitive drums 32 and the intermediate transfer belt 43 come into contact with each other.

The secondary transfer roller 71 of the secondary image-transfer unit 7 may be configured such that the secondary transfer roller 71 comes into contact with or comes away from the intermediate transfer belt 43 by a contact-separate mechanism (not illustrated). Therefore, by separating the secondary transfer roller 71 from the intermediate transfer belt 43 when an image forming operation is not performed, it is possible to prevent plastic deformation (creep) that occurs on the secondary transfer roller 71 or the surface of the intermediate transfer belt 43 when the secondary transfer roller 71 and the intermediate transfer belt 43 are in contact with each other while being stopped for a long time.

Meanwhile, when the image forming unit 48 (48Y, 48C, 48M, or 48Bk) primary transfers a toner image onto the intermediate transfer belt 43 and when the secondary image-transfer unit 7 transfers the toner image onto the recording sheet P, the primary transfer roller 46 or the secondary transfer roller 71 apply a transfer bias to the intermediate transfer belt 43. Therefore, in some cases, residual potential remains on the surface of the intermediate transfer belt 43 after the intermediate transfer belt 43 has passed through the secondary image-transfer unit 7. In this case, to prevent charge up due to the residual potential on the surface of the intermediate transfer belt 43, it is desirable to apply conductivity to the pressing roller 45 and to ground (earth) the pressing roller 45. For example, if the roller is made with metal (conductive metal), a conductive roller as described above can be obtained at low costs.

Furthermore, if the surface of the pressing roller 45 is made with an elastic material, such as rubber or sponge, the degree of attack to the surface of the intermediate transfer belt 43 is weakened. Therefore, it is possible to lengthen the lifetime of the intermediate transfer belt 43. At this time, if a conductive material is used as the elastic material of the surface of the pressing roller 45, it is also possible to prevent charge up due to the residual potential.

Furthermore, in the present embodiment, the example is explained in which the rotatable pressing roller 45 is used as the pressing member; however, it is not limited thereto. For example, a non-rotatable member, such as a pad or a pressing bar, may be used as the pressing member. When such a non-rotatable member is used, it is desirable to form a low friction film made with fluorine resin or the like on the sliding portion of the belt.

The number of the photosensitive drums 32 or the primary transfer rollers 46 to be arranged is not limited to four but may be three or smaller or five or greater.

Figure 6:
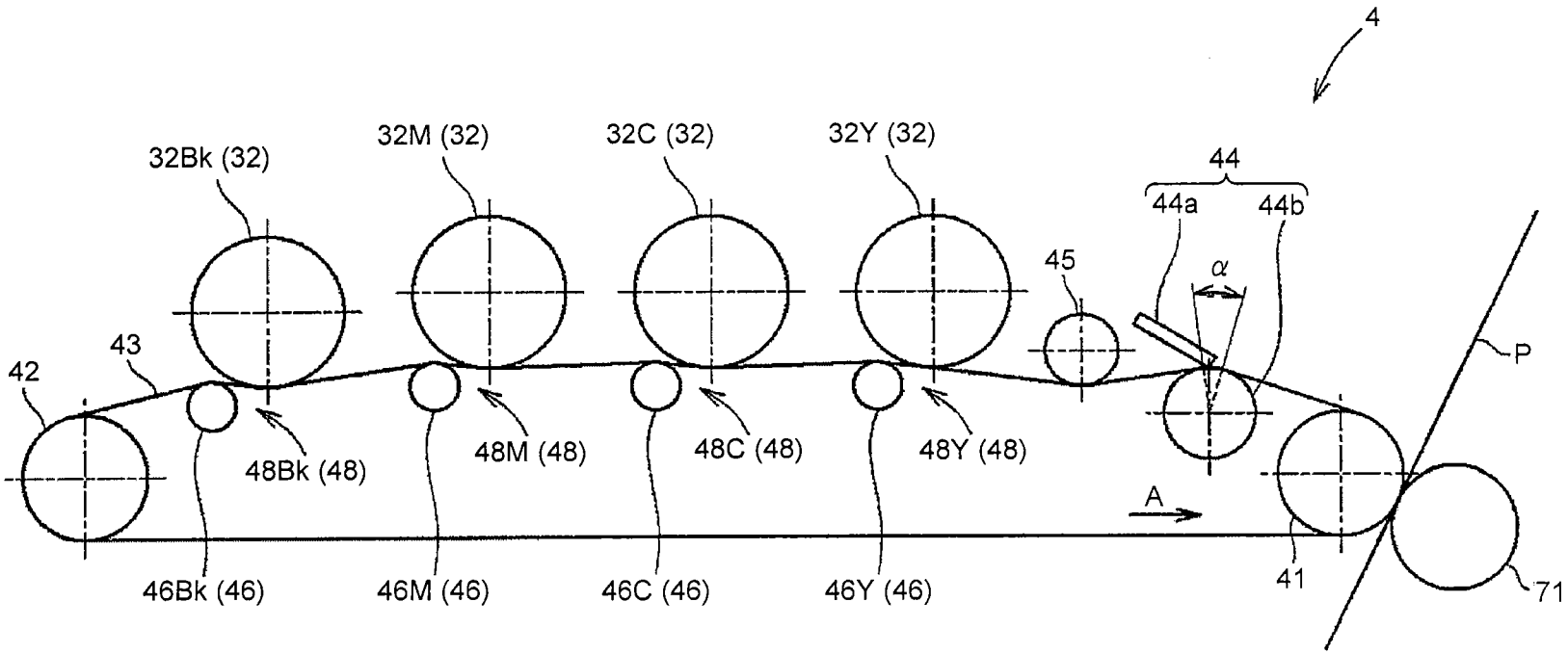
FIG. 6 is a side view illustrating a schematic configuration of a belt device according to still another embodiment.

Furthermore, in the belt device 4 of the present embodiment, the primary transfer rollers 46 are disposed just below the photosensitive drums 32 across the intermediate transfer belt 43; however, it is not limited thereto. For example, as illustrated in FIG. 6, the primary transfer rollers 46 may be disposed at a position (an offset position) deviated from the perpendicular line extending from the respective centers of the photosensitive drums 32 toward the intermediate transfer belt 43. Even in this case, the angle of contact $\alpha$ between the intermediate transfer belt 43 and the cleaning opposing roller 44*b* can be adequately secured, so that it is possible to stably move the cleaning opposing roller 44*b* and cause the cleaning blade 44*a* to stably perform cleaning.

While the embodiments of the present invention are described above, the present invention is not limited to the above embodiments. The present invention can be modified in various forms within the scope of the technical idea of the present invention. In the embodiments described above, the configuration of the present invention is applied to the belt device. However, the configuration of the present invention may be applied to a belt device that drives a photoreceptor belt, which is an electrostatic latent image carrier for carrying an electrostatic latent image on the surface thereof. Furthermore, the image forming apparatus according to the present invention is not limited to the color image forming apparatus illustrated in FIG. 1 but may be applied to a monochrome image forming apparatus, a copier, a printer, a facsimile machine, or a multifunction peripheral having functions of a copier, printer, and a facsimile machine.

According to one embodiment of the present invention, it is possible to provide a belt device that is compact in size and can easily cope with image formation in the monochrome mode.

With this configuration, the belt is pressed inward by the pressing member, so that the belt is reversely bent near the cleaning unit. With the reversely-bent state of the belt, the belt can be wound around the cleaning unit. Because the belt is wound by using the inward pressing force, it is possible to reduce an increase in size of the belt device in the thickness direction and reduce the entire size of the belt device.

Furthermore, when some of the transfer members of the image forming units are moved in a direction away from the belt, the belt is supported by the transfer member of other image forming unit and the pressing member and the transfer nips formed between the transfer members of the other image forming units and the photosensitive drums are maintained. Therefore, it is possible to transfer images onto the belt by the other image forming units in the monochrome mode. At the same time, the transfer members of the some of the image forming units are moved in a direction away from the belt such that the photosensitive drums of the some of the image forming units are separated from the belt. Therefore, rotation of the photosensitive drums of the image forming units that are not used in the monochrome mode can be stopped. As a result, it is possible to prevent abrasion of the photosensitive drums or save power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device comprising:

a belt that has an endless shape and sequentially passes through a plurality of image forming units, each of the image forming units including a transfer member and an image carrier as a pair, and the transfer member being movable in a direction in which the transfer member comes into contact with the belt and in a direction in which the transfer member is separated from the belt;

a cleaning unit that cleans an outer periphery of the belt after the belt passes through all the image forming units; and a pressing member that is disposed between the cleaning unit and the image forming unit located on the most upstream side of the plurality of image forming units in a direction of rotation of the belt and that presses the outer periphery of the belt, wherein when the transfer member of at least one of the image forming units moves in the direction in which the transfer member is separated from the belt, the transfer member of a rest of the image forming units and the pressing member support the belt, wherein the at least one of the image forming units are the image forming units other than the image forming unit located on the most downstream side of the plurality of image forming units in a direction of rotation of the belt, wherein the rest of the image forming units is the image forming unit located on the most downstream side of the plurality of image forming units in a direction of rotation of the belt, and wherein, when the transfer member of the at least one of the image forming units is separated from the belt, a line extending through a rotation center of the image carriers of the image forming units other than the image forming unit located on the most downstream side is parallel to a portion of the belt that extends between the pressing member and the image forming unit located on the most downstream side.

2. The belt device according to claim 1, wherein the cleaning unit includes:

a cleaning blade that slides on the outer periphery of the belt; and a cleaning opposing roller that comes into contact with an inner periphery of the belt at a position opposite the cleaning blade, wherein the belt is wound around the cleaning opposing roller by being pressed by the pressing roller.

3. The belt device according to claim 2, wherein an angle of contact between the belt and the cleaning opposing roller is constant before and after the transfer member of the at least one of the image forming units moves in the direction in which the transfer members come into contact with the belt or in the direction in which the transfer members are separated from the belt.

4. The belt device according to claim 1, wherein the position of the pressing member is fixed.

5. The belt device according to claim 1, wherein the position of the pressing member is movable in a direction in which the pressing member comes into contact with the belt and in a direction in which the pressing member is separated from the belt.

6. The belt device according to claim 1, wherein the pressing member is a conductive roller and is grounded.

7. The belt device according to claim 1, wherein the pressing member is a roller having a surface made with an elastic material.

8. An image forming apparatus comprising:

a belt device including:

a belt that has an endless shape and sequentially passes through a plurality of image forming units, each of the image forming units including a transfer member and an image carrier as a pair, and the transfer member being movable in a direction in which the transfer member comes into contact with the belt and in a direction in which the transfer member is separated from the belt, a cleaning unit that cleans an outer periphery of the belt after the belt passes through all the image forming units, and a pressing member that is disposed between the cleaning unit and the image forming unit located on the most upstream side of the plurality of image forming units in a direction of rotation of the belt and that presses the outer periphery of the belt, wherein when the transfer member of at least one of the image forming units moves in the direction in which the transfer member is separated from the belt, the transfer member of a rest of the image forming units and the pressing member support the belt;

a secondary image-transfer unit that transfers an unfixed image formed on the belt of the belt device onto a recording medium; and a fixing unit that fixes the image on the recording medium, wherein the at least one of the image forming units are the image forming units other than the image forming unit located on the most downstream side of the plurality of image forming units in a direction of rotation of the belt, wherein the rest of the image forming units is the image forming unit located on the most downstream side of the plurality of image forming units in a direction of rotation of the belt, and wherein, when the transfer member of the at least one of the image forming units is separated from the belt, a line extending through a rotation center of the image carriers of the image forming units other than the image forming unit located on the most downstream side is parallel to a portion of the belt that extends between the pressing member and the image forming unit located on the most downstream side.

* * * * *